United States Patent [19]

Iwer

[11] 4,216,446

[45] Aug. 5, 1980

[54] QUARTER WAVE MICROSTRIP DIRECTIONAL COUPLER HAVING IMPROVED DIRECTIVITY

[75] Inventor: Herbert W. Iwer, Tempe, Ariz.

[73] Assignee: Motorola, Inc., Schaumburg, Ill.

[21] Appl. No.: 937,362

[22] Filed: Aug. 28, 1978

[51] Int. Cl.[2] ..... H01P 5/18

[52] U.S. Cl. ..... 333/112; 333/116

[58] Field of Search ..... 333/109, 111, 115, 116, 333/112

[56] References Cited

U.S. PATENT DOCUMENTS

| | | | |
|---|---|---|---|
| 3,012,210 | 12/1961 | Nigg | 333/116 |
| 3,315,182 | 4/1967 | Woolley, Jr. | 333/115 |
| 3,593,208 | 7/1971 | Smith | 333/112 |
| 3,601,716 | 8/1971 | Bolt et al. | 333/116 |

FOREIGN PATENT DOCUMENTS

| | | | |
|---|---|---|---|
| 470025 | 5/1975 | U.S.S.R. | 333/109 |

*Primary Examiner*—Paul L. Gensler

*Attorney, Agent, or Firm*—M. David Shapiro; Eugene A. Parsons

[57] ABSTRACT

An improvement in directivity and isolation of a quarter wave microstrip directional coupler is achieved with the addition of a single capacitor placed across the directive port of the coupler.

4 Claims, 4 Drawing Figures

QUARTER WAVE MICROSTRIP DIRECTIONAL COUPLER HAVING IMPROVED DIRECTIVITY

BACKGROUND OF THE INVENTION

This invention relates to microwave directional coupling circuits, and more particularly, to coupling circuits embodied in a microstrip configuration.

Microstrip directional couplers provide acceptable signal coupling levels, but exhibit relatively poor characteristics in terms of isolation and directivity. The poor qualities of directivity and isolation arise due to the microstrip configuration, that is having a single ground plane on one side only. One technique used in the past to overcome this problem has been to insert a stripline coupler in a microstrip circuit. This technique has the obvious disadvantages of placing a portion of stripline circuitry into a microstrip structure.

Other methods in the past have been to add either lumped or distributed capacitances by interdigitizing portions of the signal line and the coupling line. Some of these structures are illustrated in an article by Allen Podell appearing in EDN magazine of Jan. 5, 1974 beginning at page 56. These structures however are designed for operation at a single frequency or over a narrow single range of frequencies, and require print and etch techniques for their construction. Their use is primarily in established designs and they are not suitable for breadboard designs. The print and etch techniques also have the associated problems of over etching or under etching thereby providing additional problems in manufacture.

Therefore, a microstrip directional coupler which is simple in construction and can be readily breadboarded, easily tuned over a wide range of frequencies, and provides high isolation across a wide bandwidth is highly desirable.

BRIEF SUMMARY OF THE INVENTION

It is therefore an object of this invention to provide a microstrip directional coupler which has improved isolation and directivity.

It is also an object of this invention to provide a microstrip directional coupler which is easily adjustable to cover a wide range of frequencies.

It is still another object of this invention to provide a microstrip directional coupler which has a large bandwidth, covering an octave or more, and exhibiting improved isolation and directivity over standard microstrip couplers.

It is also an object of this invention to provide a microstrip directional coupler which can be readily constructed in a laboratory.

An illustrated embodiment of the invention provides a substrate with a conductive coating deposited on one side of the substrate and a first conductive strip deposited on the other side together with a second conductive U-shaped strip. The base of the U-shaped strip is adjacent and parallel to the strip conductor. Added to this structure is a capacitance coupled between a corner of the U-shaped conductor and the conductive strip.

DESCRIPTION OF THE PREFERRED EMBODIMENT

Figure 1:
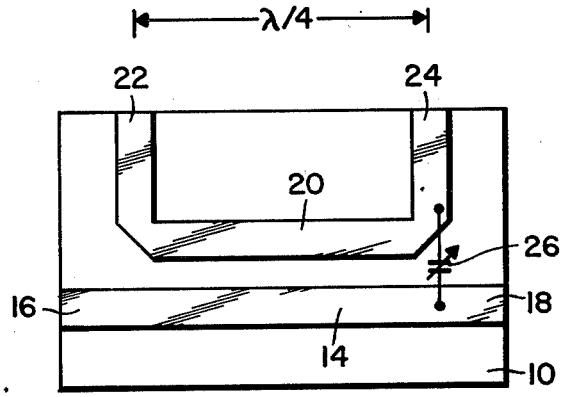
FIG. 1 is a front view of a microstrip coupler with a capacitor in place.
Figure 2:
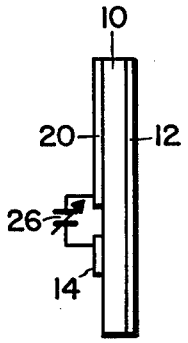
FIG. 2 is a side view of the coupler of FIG. 1.

Not referring to FIGS. 1 and 2, a substrate or dielectric 10 has a ground plane foil or conductive coating 12 on one side thereof. On the other side of the dielectric 10 is a conductive strip 14 which constitutes the main signal line having an input on the left hand side at 16 and an output on the right hand side at 18. Also on the same side of the substrate is a coupling element 20 which is generally U-shaped comprising a lateral base and two legs orthogonal to the base and having its base adjacent to and parallel with the conductive strip 14. The coupling element 20 has a signal or coupling port 22 at the left hand side of the coupler and an isolation port 24 at the right hand side of the coupler. The distance between the two legs, or the length of the base, of the coupling element 20 is equal to a quarter wavelength of the center frequency in the preferred embodiment.

The coupler as described above is common and well known in the art. To this coupler has been added a capacitor 26 which for purposes of breadboard use is adjustable in nature. The capacitor 26 is connected between the right hand corner of the U-shaped coupling connector 20 and an adjacent point on the conductive strip 14. The location the capacitor 26 is also referred to as a directive port of a coupling circuit. The exact dimensions of the conductors 14 and 20 and their placement in relation to each other is a function of the desired coupling characteristics of the design and is well known to those skilled in the art.

In operation, a signal entering at input 16 of the conductive strip 14 is coupled into the coupling element 20 and exits from the conductive strip 14 at output 18. Part of the signal is conducted into the coupling strip 20 and the ratio of the signal appearing at coupling port 22 to the signal appearing at input 16 is defined as the coupling coefficient of the circuit. Likewise the signal appearing at isolation port 24 divided by the signal appearing at input 16 is referred to as the isolation coefficient of the circuit. In an ideal coupling circuit the coupling coefficient is maximum while the isolation coefficient is a minimum. As described in the Background of the Invention the coupling coefficient of conventional microstrip couplers is acceptable, but the isolation coefficient has generally been too high for many applications. The addition of the capacitor 26 greatly reduces this isolation coefficient to a useable level. Note that the capacitor 26 is shown as a variable capacitor which is useful in breadboard application for adjusting the isolation over a variety of frequencies. A discrete capacitor which is non-adjustable could be used for a given application as in a production program.

Figure 3:
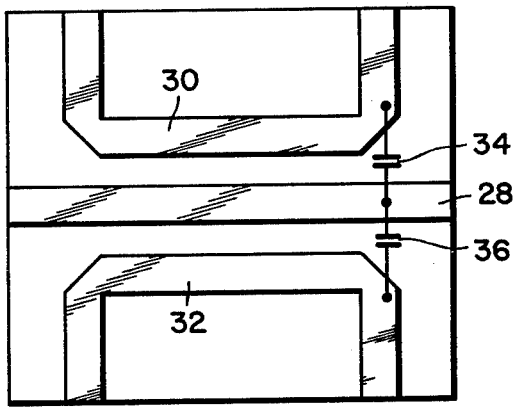
FIG. 3 is a front view of a double coupler with coupling capacitors in place.

FIG. 3 shows a dual coupler consisting of a signal conductor 28, a top coupling circuit 30 and a lower coupling circuit 32. The signal flow along the main conductor 28 is from left to right and isolation improving capacitors 34 and 36 are connected between the upper coupler 30 to the main conductor 28 and the lower conductor 32 to the main conductor 28, respectively. FIG. 3 thus serves to illustrate the adaptation of a double coupling circuit utilizing the present invention for improvement of isolation. The operation is analogous to FIG. 1 wherein a signal entering the main conductor 28 on the left hand side is coupled into the coupling circuits 30 and 32 at the same time, and, thereby, provides two isolated signals for separate functions such as power monitoring and feedback control circuitry.

The capacitors 26, 34 or 36 may be any conventional type such as Johnson variable capacitors or gimmick capacitors consisting of five or six turns of tightly wound #30 enameled magnet wire. It was found that the Gimmick capacitor could be pressed flat on the surface of the PC board with no change in operation of the coupler.

Figure 4:
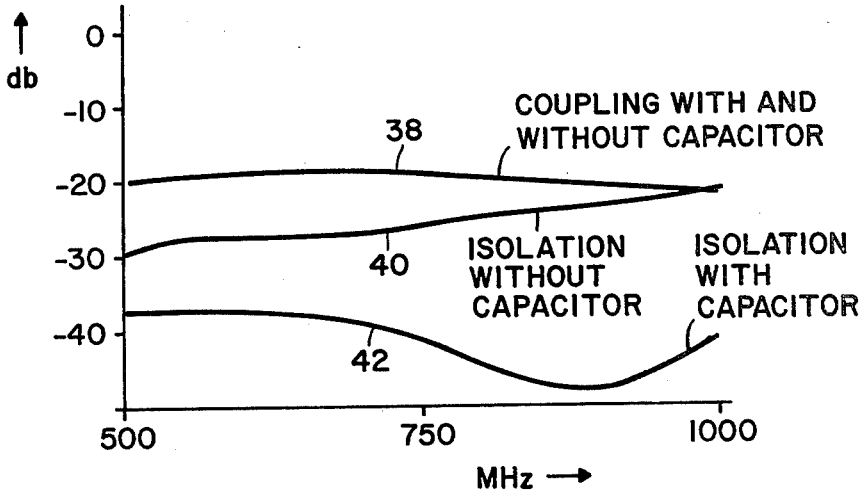
FIG. 4 is a plot of the response curves of the coupler of FIG. 1 with and without the capacitor in place.

FIG. 4 shows the operating characteristics of the coupling circuit of FIG. 1 with and without the isolation capacitor 26. Note that the horizontal axis covers an octave in frequency from 500 megahertz to 1 gigahertz. The top line 38 shows the coupling from port 16 to port 22 of FIG. 1. As will be shown below the isolation is vastly improved by capacitor 26 but the coupling is essentially unaffected. Line 40 indicates the isolation from isolation port 24 to input 16 of FIG. 1 with no capacitor 26 in place. Note that this isolation is relatively poor being greater than −30 dB. Finally line 42 indicates the isolation from isolation port 24 to input 16 with the capacitor 26 of approximately 10 picofarads in place. Note that the isolation is vastly improved varying from a high of −37 dB to a low of −47 dB. This improved isolation has not affected the coupling to any noticable extent and operates over a bandwidth of at least an octave. It would also be possible for a given frequency to adjust the capacitor to give maximum isolation and obtain a greater than 20 dB improvement over a conventional coupling circuit without any capacitor.

While the invention has been particularly shown and described with reference to the preferred embodiment shown, it will be understood by those skilled in the art that various changes may be made therein without departing from the teachings of the invention. Therefore, it is intended in the appended claims to cover all such equivalent variations as come within the scope and spirit of the invention.

What is claimed is:

1. A microwave coupling circuit comprising:

(a) a dielectric substrate;

(b) a conductive coating deposited on one side of said substrate;

(c) a first conductor forming a strip deposited on an other side of said substrate, said first conductor being at least one-quarter wavelength long;

(d) a second conductor deposited on said other side of said substrate and shaped to form a U including a base and two legs with its base parallel and adjacent to said first conductor, said base being one-quarter wavelength long; and (e) a discrete capacitance coupled only between said first conductor and approximately the junction of the base and one leg of said second conductor adjacent a directive port of the coupling circuit.

2. A microwave coupling circuit as set forth in claim 1 further comprising a third conductor deposited on said other side of said substrate which is substantially a mirror image of said second conductor and having its base parallel and adjacent to said first conductor and opposite said second conductor, and another discrete capacitance coupled only between said first conductor and the junction of the base and one leg of said second conductor adjacent said directive port.

3. A breadboard microwave coupling circuit comprising:

(a) a dielectric substrate having a conductive coating on one side;

(b) a conductive strip on the other side, said conductive strip being at least one-quarter wavelength long;

(c) a U-shaped conductor on said other side having its base parallel and adjacent to said conductor strip, said base being one-quarter wavelength long;

(d) a discrete adjustable capacitance connected only between a corner of said U-shaped conductor and said conductive strip adjacent a directive port of the coupling circuit.

4. In a one-quarter wave length long microstrip directional coupler including a signal line and a coupling element an improvement comprising a discrete capacitor placed adjacent to a directive port of said coupler and connected between the signal line and the coupling element.

* * * * *